United States Patent [19]

Uchida

[11] Patent Number: 4,936,793

[45] Date of Patent: Jun. 26, 1990

[54] LOCKING DEVICE FOR CONNECTOR

[75] Inventor: Kanzaburo Uchida, Mooka, Japan

[73] Assignee: Daiichi Denshi Kogyo Kabushiki Kaisha, Japan

[21] Appl. No.: 355,910

[22] Filed: May 23, 1989

[30] Foreign Application Priority Data

May 30, 1988 [JP] Japan ..... 63-70333[U]

[51] Int. Cl.[5] ..... H01R 13/54

[52] U.S. Cl. ..... 439/357; 439/350

[58] Field of Search ..... 439/350, 351, 352, 353, 439/354, 355, 356, 357, 358, 347

[56] References Cited

U.S. PATENT DOCUMENTS

| | | | |
|---|---|---|---|
| 3,329,925 | 7/1967 | Johnson et al. | 439/357 |
| 4,089,579 | 5/1978 | Steinbach | 439/353 |
| 4,239,317 | 12/1980 | Hesse et al. | 439/352 X |

FOREIGN PATENT DOCUMENTS

| | | | |
|---|---|---|---|
| 2909616 | 9/1980 | Fed. Rep. of Germany | 439/357 |
| 744358 | 4/1933 | France | 439/350 |

*Primary Examiner*—William Briggs

*Attorney, Agent, or Firm*—Silverman, Cass & Singer Ltd.

[57] ABSTRACT

A locking device serves to prevent connected receptacle and plug connectors from disconnecting due to external forces. The receptacle and plug connectors have substantially insulating blocks respectively supporting contacts to be connected when the receptacle and plug connectors are connected. The locking device includes anchoring recesses outwardly opening formed in outer surfaces of ends of one of the shells positioned inwardly of the other shell when connected, notches formed in ends of the other shell and positioned correspondingly to the anchoring recesses, locking pieces fixed in a hood of the other shell and extending toward the other shell, and engaging hook-shaped projections formed on the locking pieces and extending inwardly of the shell. The connected receptacle and plug connectors are to be locked so as to be prevented from disconnecting by fitting the engaging hook-shaped projections in the anchoring recesses. Miniaturization of the connector including the locking device is accomplished.

6 Claims, 3 Drawing Sheets

LOCKING DEVICE FOR CONNECTOR

BACKGROUND OF THE INVENTION

This invention relates to a locking device for a rectangular connector, and more particularly to a locking device for a rectangular connector miniaturized by shortening it lengthwise in connection with the locking device.

A small type connector for interconnecting light electric appliances consists of a receptacle connector A adapted to be fixed to a case of one appliance as shown in FIG. 1*a* and a plug connector B adapted to be connected through a cable to another appliance to be connected to the first mentioned appliance as shown in FIG. 1*b*.

The receptacle connector A comprises an insulating block 1 including a mounting plater 1*a* and a protrusion 1*d*. The insulating block 1 is formed with a fitting cavity 1*c* in which contacts 2 having contact tails 2*a* are arranged and fixed to inner side surfaces of the cavity 1*c*. The receptacle connector A further comprises a metal shell 3 surrounding the insulating block 1 and having a metal shell fixing plate 3*a* for fixing the metal shell 3 to the mounting plate 1*a* as shown in FIG. 1*a*. The mounting plate 1*a* and the metal shell fixing plate 3*a* are formed with mounting apertures 1*b* extending therethrough.

The plug connector B comprises a connector body 4 including an insulating block 4*a* and a fitting protrusion 4*b*. The fitting protrusion 4*b* includes contacts 5 having contact tails 5*a* arranged and fixed onto both side surfaces of the fitting protrusion 4*b*. The fitting protrusion 4*b* is adapted to be fitted in the fitting cavity 1*c* of the receptacle connector A to accomplish an interconnection of the receptacle and plug connectors A and B.

A metal shell 6 is fixed to the insulating block 4*a*. A connector hood 7 consists of first and second hood members 7*a* and 7*b* which are clamped as by means of set screws to hold therein the connector body 4 in a manner extending the metal shell 6 therefrom. Reference numeral 8 denotes a cable.

With such a connector as above described, the plug connector B is in general clamped to the receptacle connector A by means of a locking mechanism in order to prevent disconnection of the connectors A and B due to external tensile forces acting upon the cable 8. In more detail, as shown in FIG. 1*b* the connector hood 7 is provided therein with locking piece chambers 7*d* for accommodating locking pieces. Each of the chambers 7*d* has an opening 7*c* formed in one side surface of the hood 7. There is provided in each of chambers 7*d* a locking piece 9 including a pressing portion 9*a* at one end, a engaging hook-shaped projection 9*b* and a fulcrum portion 9*c* at an intermediate position. The locking piece 9 is enclosed in each of the chambers 7*d* so that the pressing portion 9*a* extends from the opening 7*c* and the engaging hook-shaped projection 9*b* extends toward the metal shell 6.

On the other hand, the metal shell fixing plate 3*a* of the receptacle connector A is integrally provided on both sides of the metal shell 3 with anchoring plates 10 each having an anchoring recess 10*a*. When the plug connector B has been inserted in the receptacle connector A, the engaging hook-shaped projections 9*b* are fitted in the anchoring recesses 10*a* of the anchoring plates 10.

As can be seen from FIGS. 1*a* and 1*b*, the metal shells 3 and 6 are of similar trapezoid in order to ensure only one fitted relation between the receptacle and plug connectors A and B. They are not fitted with each other in a relation in which one of the shells 3 and 6 is turned end for end through 180° relative to the other. In connecting the receptacle and plug connectors A and B, the shell 6 is fitted on the shell 3 to bring the fitting protrusion 4*b* into the fitting cavity 1*c*. In this manner, when the contacts 2 and 5 are in contact with each other, the engaging hook-shaped projections 9*b* are snugly fitted in the anchoring recesses 10*a*. The plug connector B is thus locked in the receptacle connector A with the aid of the elasticity of the locking pieces 9 as shown in FIG. 2.

On the other hand, in disconnecting the receptacle and plug connectors A and B. The hood 7 is grasped so as to press the pressing portions 9*a* extending from the openings 7*c* of the hood 7 so that the engaging hook-shaped projections 9*b* are removed from the anchoring recesses 10*a* of the anchoring plates 10 to release the locking action therebetween. The plug connector B can be disconnected from the receptacle connector A under this condition.

With the connector of the prior art, the locking pieces 9 and the anchoring plates 10 constituting the locking mechanism are positioned space apart from the metal shells 3 and 6. Therefore, the receptacle connector A becomes longer in its longitudinal directions by a distance required for providing the anchoring plates 10. Moreover, in the plug connector B, the hood 7 unavoidably becomes wider by a distance required for providing the locking pieces 9. Accordingly, the connector becomes larger against engineer's will.

In recent years, there is a tendency of pitches or intervals of contacts to be narrower so that portions for arranging the contacts become shorter. As a result, the spaces required for providing the anchoring plates 10 become larger relative to distances of the contact arranging portions. Therefore, shortening the longitudinal lengths of connectors has a limitation which would greatly obstruct the miniaturization of appliances by miniaturization of various parts.

SUMMARY OF THE INVENTION

It is an object of the invention to provide an improved locking device which enables a connector to be lengthwise shortened to fulfill the requirement of the miniaturization of connectors by eliminating spaces required for providing anchoring plate of the prior art.

It is another object of the invention to provide a configuration of connectors more meeting with the above requirement.

In order to achieve these objects, the locking device for a connector including a receptacle connector and a plug connector having substantially rectangular shells, respectively, surrounding insulating blocks respectively supporting contacts to be connected when said receptacle and plug connectors are connected according to the invention comprises anchoring recesses outwardly opening formed in outer surfaces of ends of one of the shells positioned inwardly of the other shell when connected, locking piece receiving notches formed in ends of the other shell and positioned correspondingly to said anchoring recesses, locking pieces fixed in a hood of the other shell and extending toward the other shell so that the locking pieces are positioned in the locking piece receiving notches, respectively, and engaging hook-shaped projections formed on said locking pieces and extending inwardly of the shell, thereby fitting said engaging hook-shaped projections in said anchoring recesses to lock the connected receptacle and plug connectors.

With this arrangement, the length of the receptacle can be shortened and the width of the hood can be narrowed so that the miniaturization of the connector can be accomplished.

The invention will be more fully understood by referring to the following detailed specification and claims taken in connection with the appended drawings.

DETAILED EXPLANATION OF PREFERRED EMBODIMENTS

Figure 3A:
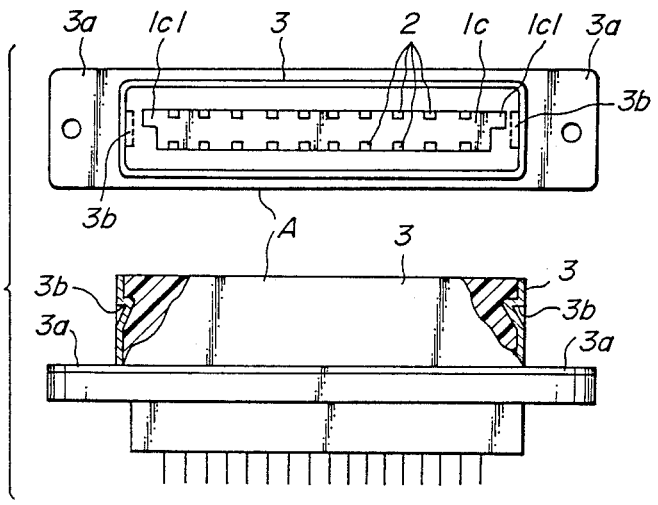
FIGS. 3*a* and 3*b* and 4 are views of a connector having a locking device according to the invention explanatorily illustrating a construction and a fitted connected condition.
Figure 3B:
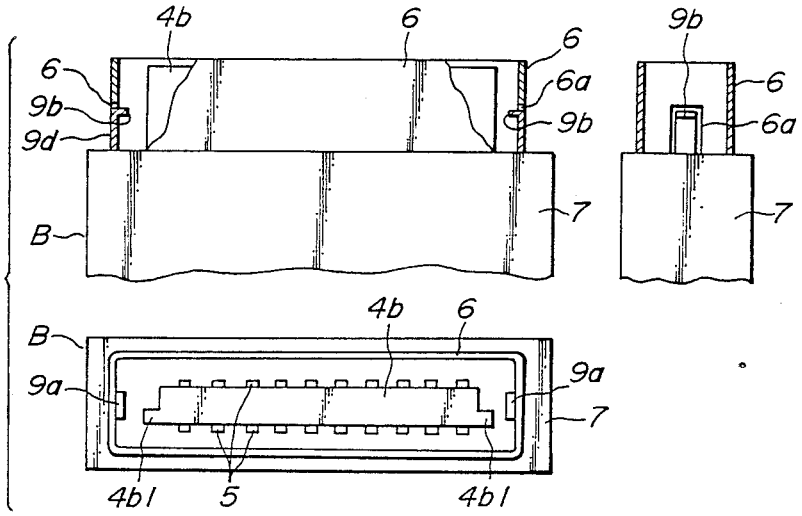

FIGS. 3*a* and 3*b* illustrate one embodiment of the invention. The locking device according to the invention is characterized in the following first and second features.

Figure 1A:
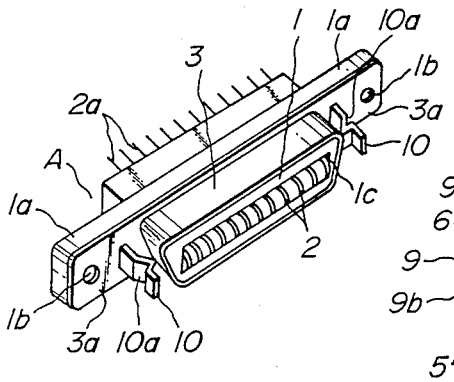
FIG 1a PRIOR ART
FIGS. 1*a* and 1*b* and 2 are views of a connector having a locking mechanism of the prior art explanatorily illustrating a construction and a fitted connected condition.
Figure 1B:
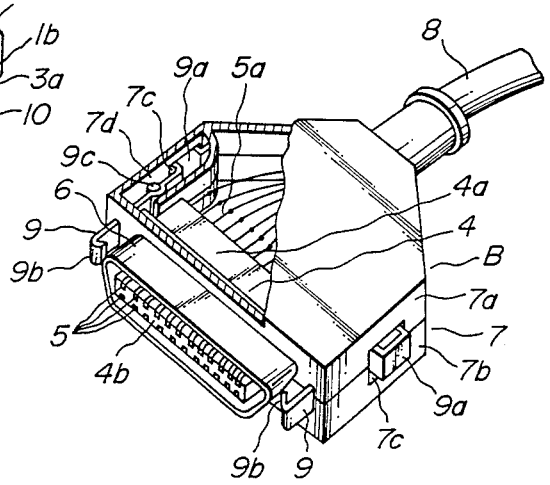
FIG 1b PRIOR ART

In the first features, shells 3 and 6 of a receptacle connector A and a plug connector B are substantially regular rectangular which are fitted with each other in a manner that the shell 6 of the plug connector B surrounds an outer circumference of the shell 3 of the receptacle connector A. The "regular rectangle" means a rectangle having opposed sides of substantially equal lengths. Such rectangular shells are different from trapezoid shells (FIGS. 1*a* and 1*b*) of the prior art. However, tolerances between the shells 3 and 4 for the fitting them may be substantially the same as those used in the prior art.

As shown in FIG. 3*a*, the shell 3 of the receptacle connector A is formed on both ends with anchoring recesses 3*b* outwardly opening. The anchoring recesses 3*b* may be formed in any configuration so long as they can be fitted with engaging hook-shaped projections 9*b* of locking pieces 9 latter described to prevent any removal of the plug connector B from the receptacle connector A.

On the other hand, as shown in FIG. 3*b* the shell 6 of the plug connector B is formed on both end surfaces with notches 6*a* for receiving locking pieces 9. The notches 6*a* may be formed in any configurations and sizes other than those shown, so long as they are sufficient to provide spaces for the locking pieces 9 provided along ends of the shell 6 of the plug connector B. However, excessively large notches are not preferable because of decrease in structural strength of shell 6. Moreover, the locking pieces 9 are secured to a connector hood 7 such that they can be inserted into the notches 6*a* in opposition relations and locating surfaces 9*d* of the engaging hook-shaped projections 9*b* are flush with end surfaces of the shell 6. The engaging hook-shaped projections 9*b* of the locking pieces 9 are positioned facing inwardly toward each other.

In second features according to the invention, as shown in FIGS. 3*a* and 3*b*, a fitting cavity 1*c* of the receptacle connector A is formed with recesses 1*c*1 at both ends of the cavity, and a fitting protrusion 4*b* of the plug connector B is formed with projections 4*b*1 at ends corresponding to the recesses 1*c*1. The recesses 1*c*1 and the projections 4*b*1 form key means which regulate the fitted relation between the receptacle and plug connectors A and B to ensure only one fitted relation therebetween. They are not fitted with each other in a relation in which one of the shells 3 and 6 is turned end for end through 180° relative to the other.

In this embodiment, widths of the recesses 1*c*1 and the projections 4*b*1 are less than widths of the fitting cavity 1*c* and the fitting protrusion 4*b*. However, such dimensional feature is not necessarily required. Moreover, the recesses 1*c*1 and the projections 4*b*1 may be any shapes other than those shown in the drawings so long as they are not in symmetry with respect to longitudinal center lines of the fitting cavity 1*c* and fitting protrusion 4*b*.

Figure 4:
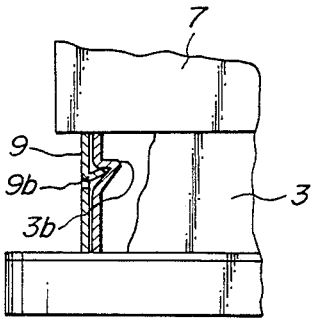

With this arrangement, when the fitting protrusion 1*c* of the plug connector B is inserted into the fitting cavity 1*c* with the projections 4*b*1 and recesses 1*c*1 of the key means being in registry with each other, the engaging hook-shaped projections 9*b* of the locking pieces 9 provided on the plug connector B are fitted in the anchoring recesses 3*b* provided on both the ends of the shell 3 of the receptacle connector A to complete the locking of the receptacle and plug connectors A and B as shown in FIG. 4.

EXAMPLES

Examples of the locking device according to the invention shown in FIGS. 3*a* and 3*b* will be explained hereinafter.

The metal shell 3 of the receptacle connector A was made of a thin brass plate, which was formed by a press into a rectangular shell having a length of 47 mm and a width of 12 mm and plated by chromium.

The anchoring recesses 3*b* had a depth of 2.0 mm at the deepest positions and a width of 4 mm which was about one third of the width of the metal shell 3.

The metal shell 6 of the plug connector B was made by the same method as for the metal shell 3 and sizes of the metal shell 6 were substantially equal to those of the metal shell 3 with exception of its outer circumferential dimension was 0.1 mm larger than that of the metal shell 3.

A width of the notches 6*a* was 4 mm equal to that of the anchoring recesses 3*b*.

Figure 2:
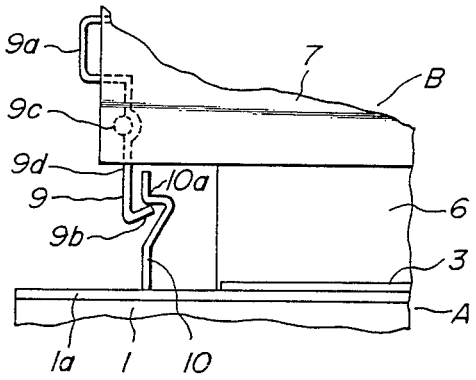
FIG 2 PRIOR ART

The locking pieces 9 were made of a steel plates having a width of 3.5 mm whose tip ends were bent substantially at right angles to form the engaging hook-shaped projections 9*b*. Each of the locking pieces 9 was supported rotatably through a constant angle by a cylindrical fulcrum portion 9*c* whose half circumferential face was in contact with the locking piece 9 in the same manner as shown in FIG. 2 illustrating the prior art.

Sides of the recesses 1*c*1 of the key means were approximately 2 and 2 mm, while sides of the projections 4*b*1 were 0.1 mm smaller than those of the recesses 1*c*1. These key means were integrally formed with the fitting cavity 1*c* and protrusion 4*b* and made by an insulating plastic material or P.B.T. (polybutylene terephthalate). Any other sizes and materials may be used for the key means.

Although the above embodiment and example are preferable, any other modifications and changes may be made in the invention.

Figure 5A:
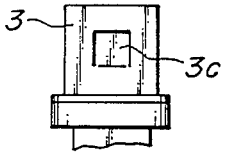
FIGS. 5*a* and 5*b* and 6*a* and 6*b* are explanatory views illustrating other embodiments of the locking device according to the invention.
Figure 5B:
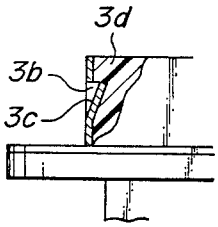

For example, as shown in FIG. 5*a*, each of the anchoring recesses 3*b* may be formed by forming an inverted U-shaped slit in the end face of the metal shell 3 and then pressing a rectangular tongue 3*c* formed by the U-shaped slit inwardly into an inclined position. In this case, it is preferable that after a product having recesses for receiving the rectangular tongues 3*c* has been previously molded, the molded product is inserted into the metal shell 3 from bellow viewed in FIG. 5*b*. No trouble occurs in such an insertion of the product into the metal shell 3 because of an elasticity of the tongues 3*c*.

Figure 6A:
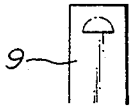
Figure 6B:
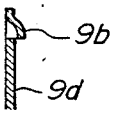

As shown in FIGS. 6*a* and 6*b*, moreover, each of the engaging hook-shaped projections 9*b* of the locking pieces 9 may be formed by forming a hemispherical punched projection in the proximity of a tip end of the locking piece 9 by pressing.

As can be seen from the above description, according to the invention the engaging hook-shaped projections 9*b* and the anchoring recesses 3*b* are positioned at both the ends of the shells 3 and 6 without requiring any spaces on outsides of the shells for providing locking mechanism. Therefore, with the receptacle connector A the length of the mounting plate 1*a* is shortened by a length of the locking mechanism, so that the connector can be shortened correspondingly. Moreover, since positions of the locking pieces 9 of the plug connector B are determined corresponding to the shortened receptacle connector A, a width of the connector hood 7 is also narrowed correspondingly. Therefore, a miniaturization of the connector can be accomplished.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A locking device for a connector including a receptacle connector and a plug connector having substantially rectangular shells, respectively, surrounding insulating blocks respectively supporting contacts to be connected when said receptacle and plug connectors are connected, comprising anchoring recesses outwardly opening formed in outer surfaces of ends of one of the shells positioned inwardly of the other shell when connected, locking piece receiving notches formed in ends of the other shell and positioned correspondingly to said anchoring recesses, locking pieces fixed in a hood of the other shell and extending toward the opposite shell when connected so that the locking pieces are positioned in the locking piece receiving notches, respectively, and engaging hook-shaped projections formed on said locking pieces and extending inwardly of said other shell, thereby fitting said engaging hook-shaped projections in said anchoring recesses to lock the connected receptacle and plug connectors, said insulating blocks of the receptacle and plug connectors being provided with a fitting cavity and a fitting protrusion, respectively, to be fitted when said receptacle and plug connectors are connected, and the fitting cavity and the fitting protrusion are provided with key means comprising a key recess and a key projection to regulate only one fitted relation of the insulating blocks.

2. A locking device for a connector as set forth in claim 1, wherein each of the engaging hook-shaped projections is formed by forming a hemispherical punched projection at a tip end of the locking piece by pressing.

3. A locking device for a connector as set forth in claim 1, wherein said key means is provided at least one end of each of the fitting cavity and the fitting protrusion.

4. A locking device for a connector as set forth in claim 3, wherein widths of said key recess and said key projection are less than widths of said fitting cavity and said fitting protrusion.

5. A locking device for a connector as set forth in claim 1, wherein each of the anchoring recesses is formed by forming an inverted U-shaped slit in the one shell and then pressing a rectangular tongue formed by the U-shaped slit inwardly into an inclined position.

6. A locking device for a connector as set forth in claim 5, wherein said insulating block is one previously molded to have recesses for receiving rectangular tongues.

* * * * *